US010889910B2

(12) United States Patent
Chen et al.

(10) Patent No.: US 10,889,910 B2
(45) Date of Patent: Jan. 12, 2021

(54) BORON-CONTAINING LOW-CARBON STEEL OXIDE FILM AND PREPARATION METHOD THEREOF

(71) Applicant: Tianjin University of Technology, Tianjin (CN)

(72) Inventors: Minfang Chen, Tianjin (CN); Yankun Li, Tianjin (CN); Chen You, Tianjin (CN); Haifeng Liu, Tianjin (CN)

(73) Assignee: Tianjin University of Technology, Tianjin (CN)

( * ) Notice: Subject to any disclaimer, the term of this patent is extended or adjusted under 35 U.S.C. 154(b) by 0 days.

(21) Appl. No.: 16/367,907

(22) Filed: Mar. 28, 2019

(65) Prior Publication Data

US 2019/0301045 A1 Oct. 3, 2019

(30) Foreign Application Priority Data

Apr. 2, 2018 (CN) ..... 2018 1 0281232

(51) Int. Cl.
*C25D 11/34* (2006.01)
*C25D 11/02* (2006.01)

(52) U.S. Cl.
CPC ..... *C25D 11/34* (2013.01); *C25D 11/024* (2013.01); *C25D 11/026* (2013.01); *C25D 11/028* (2013.01)

(58) Field of Classification Search
CPC ..... C25D 11/026; C25D 11/024
See application file for complete search history.

(56) References Cited

U.S. PATENT DOCUMENTS

2019/0016028 A1* 1/2019 Chang ..... C25D 11/06

FOREIGN PATENT DOCUMENTS

CN 102660712 A * 9/2012
CN 104831333 A * 8/2015
CN 106086980 A * 11/2016
KR 101819918 B1 * 2/2018

OTHER PUBLICATIONS

Machine translation of CN104831333 of Hu (Year: 2015).*
Machine translation of KR101819918 of Yun (Year: 2018).*
Machine translation of CN106086980 of Song (Year: 2016).*
Yang et al; "A comparative study of characterization of plasma electrolytic oxidation coatings on carbon steel prepared from aluminate and silicate electrolytes" Surface Engineering, 2018, p. 54-62. (Year: 2017).*

* cited by examiner

*Primary Examiner* — Brian W Cohen
(74) *Attorney, Agent, or Firm* — Wood Herron & Evans LLP

(57) ABSTRACT

A method for preparing a boron-containing low-carbon steel oxide film includes performing micro-arc oxidation on boron-containing low-carbon steel in an electrolyte by using the boron-containing low-carbon steel as an anode, to obtain a boron-containing low-carbon steel oxide film. The electrolyte contains sodium meta aluminate of 5 g/L to 25 g/L, sodium dihydrogen phosphate of 2 g/L to 10 g/L, sodium carbonate of 2 g/L to 15 g/L, and glycerol of 2 g/L to 8 g/L. The preparation method provided by the present invention has a simple and controllable process, and the obtained boron-containing low-carbon steel oxide film has a secure bond with the substrate, thus effectively avoiding occurrence of galvanic corrosion.

8 Claims, 2 Drawing Sheets

BORON-CONTAINING LOW-CARBON STEEL OXIDE FILM AND PREPARATION METHOD THEREOF

CROSS-REFERENCE TO RELATED APPLICATION

This application claims priority to Chinese application number 201810281232.7, filed on Apr. 2, 2018. The above-mentioned patent application is incorporated herein by reference in its entirety.

TECHNICAL FIELD

The present invention relates to the field of metal surface treatment technologies, and in particular, relates to a steel oxide film and preparation method thereof.

BACKGROUND

In recent years, organizations such as the world's major car manufacturers, steel associations, and aluminum industry associations, and some steel mills have carried out several studies on automobile lightweight projects. Lightweight materials such as magnesium alloys are widely selected for the purpose of automobile lightweight. As the main material for automobiles, Al—Mg alloy AZ91 has a broad prospect for development.

However, the Al—Mg alloy AZ91 has the following salient problems in application of automobile lightweight:

1. The magnesium alloy can be used to make most of the parts of an automobile due to its high strength but cannot be used to replace the traditional alloy special steel to make the key bearing structural parts and connecting parts. Instead, only boron-containing low-carbon steel can be selected to connect magnesium-alloy structural parts of the automobile in a punching and riveting manner.

2. The problem of contact corrosion occurs. Magnesium is an active metal and has an electrode potential of −2.37V, while the alloy, the boron-containing low-carbon steel, has an electrode potential of −0.44V. There is a large difference in potential between the two metals. Contact galvanic corrosion spontaneously occurs between the two metals after they directly contact, and consequently, the magnesium alloy with a low potential severely corrodes, leading to material performance failure. Therefore, a contact portion between the two metals is necessarily coated with an anti-wear film to inhibit the occurrence of contact corrosion.

All the existing solutions are to carry out surface treatment on the magnesium alloy. For example, nitric acid is applied on the surface of the magnesium alloy for deactivation, to form a dense nanoparticle protective layer. As a result, the surface resistance thereof is increased by a factor of 12. The magnesium alloy having undergone surface deactivation is connected to a galvanized rivet. Assessed according to the GJB594A-2000 standard, this interface connection combination has a corrosion grade of 0 to 1 and an obviously reduced tendency to galvanic corrosion, and thus can be used in all conditions except the tropical oceanic environment. However, this solution still has the tendency to contact corrosion, and further has problems of high costs, a complicated process, and pollution from waste liquid of nitric acid during surface deactivation on magnesium alloy parts of a large-sized car.

Instead of surface treatment on the magnesium alloy, coating a steel structural part connected to the magnesium alloy with a film has been considered in the prior art.

However, the major techniques of the conventional steel surface treatment, such as spraying, hot dip plating, chemical heat treatment, and electroplating, all have disadvantages of poor coating adhesion, low efficiency, a long treatment time, high costs, severe environmental pollution, and most importantly, inability to avoid the strong tendency to galvanic corrosion.

For example, the rivet used for punching and riveting in a car is made from the boron-containing low-carbon steel (10B21) and is plated with zinc, where the plating has a thickness of 100 μm. The potential difference between the metal Zn and the major metallic element Mg in the alloy AZ91 is about 0.667 V, which falls in a danger zone where galvanic corrosion easily occurs.

Moreover, the plating process is implemented generally by combining techniques of hot dip plating and micro-arc oxidation. Specifically, micro-arc oxidation is performed on the steel having undergone hot dip plating, to enhance protection of the film. In essence, micro-arc oxidation is performed on aluminum plating. Therefore, the performance of the surface film thereof depends on the aluminum layer formed through the hot dip plating, instead of a ceramic layer formed through the micro-arc oxidation. This process is based on the hot dip aluminizing technique which has a salient problem of poor bonding between aluminum plating and a substrate. Therefore, a coating prepared by means of hot dip plating in combination with micro-arc oxidation on the steel surface easily falls off; and the strength, wear resistance and corrosion resistance of the coating are far from satisfactory. In addition, the process has a complicated course, and there is a strict requirement on parameters of the process, leading to low production efficiency and high production costs.

Thus, it would be desirable to provide a method for preparing a boron-containing low-carbon steel oxide film. To this end, it is desired that the method defines a simple and controllable process, with the obtained steel oxide film being able to create a secure bond with a substrate, enhancing the strength, wear resistance and corrosion resistance of the film.

SUMMARY

To achieve the above purposes and solve the technical defects with the conventional methods as noted above, the present invention provides the following technical solution, in one embodiment. A method for preparing a boron-containing low-carbon steel oxide film includes the following steps: performing micro-arc oxidation on boron-containing low-carbon steel in an electrolyte by using the boron-containing low-carbon steel as an anode, to obtain a boron-containing low-carbon steel oxide film, where the electrolyte contains sodium meta aluminate of 5 g/L to 25 g/L, sodium dihydrogen phosphate of 2 g/L to 10 g/L, sodium carbonate of 2 g/L to 15 g/L, and glycerol of 2 g/L to 8 g/L.

In one embodiment, parameters of the micro-arc oxidation include: current density of 0.5 mA/cm$^2$ to 300 mA/cm$^2$, a positive voltage of 450V to 700V, a negative voltage of 50V to 100V, a current frequency of 200 Hz to 2000 Hz, a ratio of positive frequency to negative frequency of 0.5 to 2, a positive duty ratio of 15% to 40%, a negative duty ratio of 10% to 25%, reaction duration of 20 min to 50 min, and a reaction temperature of 20° C. to 60° C.

In one aspect, the electrolyte further contains sodium tetraborate of 1 g/L to 10 g/L.

In another aspect, parameters of the micro-arc oxidation include: current density of 0.1 mA/cm$^2$ to 300 mA/cm$^2$, a positive voltage of 500V to 700V, a negative voltage of 20V to 80V, a current frequency of 200 Hz to 2000 Hz, a ratio of positive frequency to negative frequency of 1 to 2, a positive duty ratio of 15% to 40%, a negative duty ratio of 10% to 20%, reaction duration of 20 min to 60 min, and a reaction temperature of 20° C. to 60° C.

In a further aspect, the pH value of the electrolyte is 8 to 12.

In yet another aspect, the boron-containing low-carbon steel is polished, degreased, and pickled successively before the micro-arc oxidation.

In one aspect, the degreasing is performed in an alkaline solution at the temperature of 70° C. to 90° C.

In another aspect, the pickling is performed in an acid solution at the temperature of 30° C. to 70° C.

According to another embodiment, the present invention further provides a boron-containing low-carbon steel oxide film obtained by using the above preparation method, including an $Al_2O_3$ ceramic film covering a boron-containing low-carbon steel substrate.

In one aspect, the $Al_2O_3$ ceramic film has a thickness of 50 μm to 100 μm, and an insulation resistance of 100 MΩ to 150 MΩ.

The present invention provides a method for preparing a boron-containing low-carbon steel oxide film, including the following step: performing micro-arc oxidation on boron-containing low-carbon steel in an electrolyte by using the boron-containing low-carbon steel as an anode, to obtain a boron-containing low-carbon steel oxide film. The electrolyte selected in the preparation method of the present invention is composed of sodium meta aluminate, sodium dihydrogen phosphate, sodium carbonate, and glycerol. By controlling the composition of the electrolyte and the contents, an $Al_2O_3$ ceramic film is grown in situ on the surface of the boron-containing low-carbon steel. This ceramic film has a dense and uniform structure, and creates a secure metallurgical bond with the substrate, thus significantly enhancing the strength, wear resistance and corrosion resistance of the film. An experimental result shows that: the Moh's hardness of the $Al_2O_3$ ceramic film obtained by means of micro-arc oxidation reaches 8.5 to 9, the friction coefficient thereof is 0.2 to 0.3 through a friction and wear test, and an annual corrosion rate thereof is 0.03 mm/y to 0.07 mm/y through analysis from a neutral salt spray test.

Moreover, the boron-containing low-carbon steel oxide film obtained by the present invention includes the $Al_2O_3$ ceramic film covering the boron-containing low-carbon steel. An insulation resistance of the $Al_2O_3$ ceramic film reaches up to 100 MΩ to 150 MΩ, which is equivalent to using an insulator to close an interfacial gap between a boron-containing low-carbon steel rivet and a contact metal (magnesium alloy). Thus, an electron flow circuit is suppressed, and galvanic corrosion is avoided.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitutes a part of this specification, illustrate one or more embodiments of the invention and, together with the general description given above and the detailed description given below, explain the one or more embodiments of the invention.

DETAILED DESCRIPTION

Figure 1:
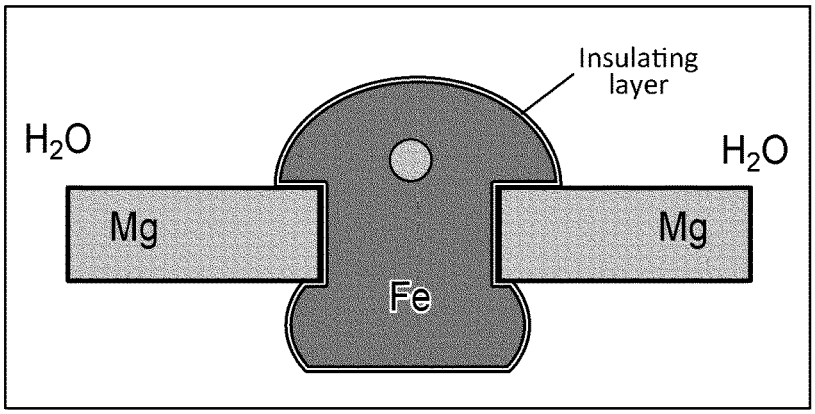
FIG. 1 is a schematic (simulated) diagram of a boron-containing low-carbon steel oxide film prepared by the method of one embodiment of the present invention, where an insulator is an $Al_2O_3$ ceramic film.

The following clearly and completely describes the technical solutions in the embodiments of the present invention with reference to the accompanying drawings in the embodiments of the present invention. To make objectives, features, and advantages of the present invention clearer, the following describes embodiments of the present invention in more detail with reference to accompanying drawings and specific implementations.

In one embodiment, the present invention provides a method for preparing a boron-containing low-carbon steel oxide film, which includes the following step: micro-arc oxidation is performed on boron-containing low-carbon steel in an electrolyte by using the boron-containing low-carbon steel as an anode, to obtain a boron-containing low-carbon steel oxide film. The electrolyte contains sodium meta aluminate of 5 g/L to 25 g/L, sodium dihydrogen phosphate of 2 g/L to 10 g/L, sodium carbonate of 2 g/L to 15 g/L, and glycerol of 2 g/L to 8 g/L.

In the present invention, micro-arc oxidation is performed on the boron-containing low-carbon steel in the electrolyte by using the boron-containing low-carbon steel as an anode, to obtain the boron-containing low-carbon steel oxide film. In the present invention, boron-containing low-carbon steel of model 10B21 is preferably used. Different from an oxide ceramic coating formed after micro-arc oxidation of the boron-containing low-carbon steel selected in the present invention with nonferrous metals such as Ti, Al, and Mg, neither $Fe(OH)_3$ nor $Fe_2O_3$ produced on the boron-containing low-carbon steel by using an alkaline solution in an oxygen condition is a ceramic insulator. Moreover, the produced ferric hydroxide or ferric oxide cannot meet the use requirements for a coating in terms of both strength and its adhesion to the substrate. Therefore, other metallic elements need to be introduced during film coating for the boron-containing low-carbon steel. $Al_2O_3$ ceramic approximates the metal Fe in the coefficient of thermal expansion, and a composite ceramic transition layer $FeO.Al_2O_3$ can be generated during micro-arc oxidation, to form an $Al_2O_3$ ceramic insulating film on the steel surface.

In the present invention, the electrolyte contains sodium meta aluminate of 5 g/L to 25 g/L, sodium dihydrogen phosphate of 2 g/L to 10 g/L, sodium carbonate of 2 g/L to 15 g/L, and glycerol of 2 g/L to 8 g/L.

In the present invention, the electrolyte preferably contains sodium meta aluminate of 10 g/L to 20 g/L, and more preferably, contains sodium meta aluminate of 15 g/L. In the present invention, the sodium meta aluminate is a main source of aluminum ions in the micro-arc oxide film on the surface of the boron-containing low-carbon steel. Moreover, the sodium meta aluminate can provide an alkaline electrolyte environment, and further enhance the hardness, wear resistance and corrosion resistance of the basic $Al_2O_3$ film.

In the present invention, the electrolyte preferably contains sodium dihydrogen phosphate of 4 g/L to 8 g/L, and more preferably, contains sodium dihydrogen phosphate of 5 g/L. In the present invention, the sodium dihydrogen phosphate can enhance the stability of the electrolyte, continuously stabilize an electric arc during micro-arc oxidation, and promote film growth.

In the present invention, the electrolyte preferably contains sodium carbonate of 4 g/L to 12 g/L, and more preferably contains sodium carbonate of 6 g/L to 10 g/L. In the present invention, the sodium carbonate produces the gas $CO_2$ during decomposition, which promotes growth of the electric arc, provides space for generation of the electric arc in the surface film, and further promotes in-situ growth and thickness increase of the film.

In the present invention, the electrolyte preferably contains glycerol of 2 g/L to 8 g/L, and more preferably contains glycerol of 5 g/L. In the present invention, as a stabilizer, the glycerol is mainly used to stabilize the electrolyte, and avoid a discharge and ablation phenomenon at the liquid surface between a workpiece and the electrolyte during micro-arc oxidation.

In the present invention, when the electrolyte contains sodium meta aluminate, sodium dihydrogen phosphate, sodium carbonate, and glycerol, the parameters of the micro-arc oxidation process preferably include: current density of 0.5 mA/cm$^2$ to 300 mA/cm$^2$, a positive voltage of 450V to 700V, a negative voltage of 50V to 100V, a current frequency of 200 Hz to 2000 Hz, a ratio of positive frequency to negative frequency of 0.5 to 2, a positive duty ratio of 15% to 40%, a negative duty ratio of 10% to 25%, reaction duration of 20 min to 50 min, and a reaction temperature of 20° C. to 60° C. The parameters more preferably include: current density of 10 mA/cm$^2$ to 100 mA/cm$^2$, a positive voltage of 500V to 600V, a negative voltage of 60V to 80V, a current frequency of 500 Hz to 1000 Hz, a ratio of positive frequency to negative frequency of 1 to 1.5, a positive duty ratio of 20% to 30%, a negative duty ratio of 15% to 20%, reaction duration of 30 min to 40 min, and a reaction temperature of 30° C. to 50° C.

The positive voltage and the positive duty ratio promote growth of the ceramic layer. An excessively high positive voltage and positive duty ratio may result in excessively large pores in the ceramic layer, affecting the film quality and causing high occurrence of an amorphous phase. An excessively low positive voltage and positive duty ratio may create an excessively thin ceramic layer. The coating can be decomposed under the negative voltage and the negative duty ratio. An excessively high negative voltage and negative duty ratio may slow down growth of the film and reduce its thickness, while an excessively low negative voltage and negative duty ratio may result in poor film quality and high occurrence of the amorphous phase. The current frequency affects the size of the pores in the film and the thickness of the film. An excessively high frequency creates a thin film, while an excessively low frequency results in excessively large pores in the film. The reaction duration affects the thickness of the film. Excessively short duration creates a thin film, while excessively long duration creates a thick film, affecting the size of the workpiece. The reaction temperature affects the film quality. An excessively high temperature accelerates decomposition of the film. An excessively low temperature renders deposition and growth of the film extremely slow.

In the present invention, the electrolyte preferably further contains sodium tetraborate of 1 g/L to 10 g/L, and more preferably contains sodium tetraborate of 5 g/L. In the present invention, the sodium tetraborate produces boric acid during decomposition. The boric acid can decompose the ferric oxide produced during micro-arc oxidation and increase the content of aluminum oxide in the film, thus flattening the micro-arc oxide layer and further enhancing the density of the film.

In the present invention, when the electrolyte contains sodium meta aluminate, sodium dihydrogen phosphate, sodium carbonate, glycerol, and sodium tetraborate, the parameters of the micro-arc oxidation process preferably include: current density of 0.1 mA/cm$^2$ to 300 mA/cm$^2$, a positive voltage of 500V to 700V, a negative voltage of 20V to 80V, a current frequency of 200 Hz to 2000 Hz, a ratio of positive frequency to negative frequency of 1 to 2, a positive duty ratio of 15% to 40%, a negative duty ratio of 10% to 20%, reaction duration of 20 min to 60 min, and a reaction temperature of 20° C. to 60° C. In the present invention, the parameters of the micro-arc oxidation process more preferably include: current density of 10 mA/cm$^2$ to 100 mA/cm$^2$, a positive voltage of 500V to 600V, a negative voltage of 60V to 80V, a current frequency of 500 Hz to 1000 Hz, a ratio of positive frequency to negative frequency of 1 to 1.5, a positive duty ratio of 20% to 30%, a negative duty ratio of 15% to 20%, reaction duration of 30 min to 40 min, and a reaction temperature of 30° C. to 50° C.

In the present invention, the electrolyte for the micro-arc oxidation process and the process parameters are the key to formation of a qualified film. The film performance varies with different compositions of the electrolyte and different settings of the oxidation process parameters. The composition of the electrolyte and the process parameters matching up with the composition affect the thickness, hardness, porosity, and surface roughness of the film. The setting of the parameters affects the occurrence of the amorphous phase. The existence of the amorphous phase has a bad influence on the film quality. The composition of the electrolyte affects the composition, the shape, and the structure of the film. The sodium aluminate provides main elements for the aluminum oxide in the film. The sodium carbonate promotes the growth of the film and the deposition of an aluminum oxide film. The sodium tetraborate can decompose the ferric oxide produced on the surface of the workpiece, thus promoting the generation of the aluminum oxide, enhancing the content of the aluminum oxide in the film, enhancing the thickness and hardness of the film, and reducing the porosity and surface roughness of the film. In the present invention, micro-arc oxidation is performed on the boron-containing low-carbon steel by using the electrolyte with a specific composition and formula, to form an $Al_2O_3$ ceramic film on the steel surface. Such a film has a dense and uniform structure, and creates a secure metallurgical bond with the substrate, thus significantly enhancing the hardness, wear resistance and corrosion resistance of the film.

In the present invention, the pH value of the electrolyte is preferably between 8 to 12, or even more preferably, 10. In the present invention, micro-arc oxidation is performed in an alkaline environment with the pH value of 8 to 12, which can promote the growth of the oxide in the film.

In the present invention, the boron-containing low-carbon steel is polished, degreased, and pickled successively before the micro-arc oxidation.

The present invention does not particularly limit the polishing treatment, and the conventional polishing technique in the field can be used. In the present invention, the polishing preferably includes chemical polishing and mechanical polishing. In the present invention, the polishing treatment can remove impurities from the surface and reduce the surface roughness.

In the present invention, the degreasing treatment is preferably performed in an alkaline solution. The alkaline solution is preferably one, or a mixture of two or more, of a sodium hydroxide solution, a potassium hydroxide solution and a calcium hydroxide solution; and is preferably the sodium hydroxide solution in the present invention. In the present invention, the temperature of the degreasing treatment is preferably 70° C. to 90° C., and is more preferably 80° C. The present invention does not have a particular requirement on the degreasing duration, and the degreasing purpose of the present invention is to prevent the oil from affecting the surface conductivity and the deposition of the oxide in the film.

In the present invention, the pickling treatment is preferably performed in an acid solution. The acid solution is preferably one, or a mixture of two or more, of hydrochloric acid, sulfuric acid, and nitric acid. In an embodiment of the present invention, the acid solution is preferably a mixed solution of hydrochloric acid and sulfuric acid, and the volume ratio of the hydrochloric acid to the sulfuric acid is preferably 3:1. In the present invention, the temperature of the pickling treatment is preferably 30° C. to 70° C., and is more preferably 40° C. to 60° C. The pickling duration is preferably 3 min to 20 min, and is more preferably 5 min to 15 min. In the present invention, the pickling treatment can remove rust from the surface of the boron-containing low-carbon steel.

In the present invention, the polishing, degreasing, and pickling treatments successively performed on the boron-containing low-carbon steel before micro-arc oxidation can smooth and brighten the surface of the steel workpiece (namely, the boron-containing low-carbon steel), to meet the treatment requirements for the surface micro-arc oxidation process.

In the present invention, after the pickling treatment is finished, a product obtained after the pickling is preferably put in running clean water for cleaning, to remove waste fluid left after the pickling and obtain boron-containing low-carbon steel.

In the present invention, after the micro-arc oxidation is finished, a product obtained after the micro-arc oxidation is cleaned and dried successively, to obtain a boron-containing low-carbon steel oxide film.

In the present invention, the cleaning preferably successively includes cleaning with clean water and ultrasonic cleaning with anhydrous ethanol. The present invention does not have particular requirements on the cleaning manner and cleaning parameters, and the conventional cleaning technique in the field can be used. In the present invention, residual electrolyte and loose particles on the surface of the film can be washed away by means of the cleaning with clean water. In the present invention, the residual electrolyte in the pores of the porous film and loose particles can be removed from the surface by means of the ultrasonic cleaning with anhydrous ethanol.

In the present invention, the drying is preferably drying by air blowing. The present invention does not have particular requirements on the drying duration, drying temperature, and other conditions. The conventional air-blowing technique in the field can be used to obtain a dry boron-containing low-carbon steel oxide film.

Figure 2:
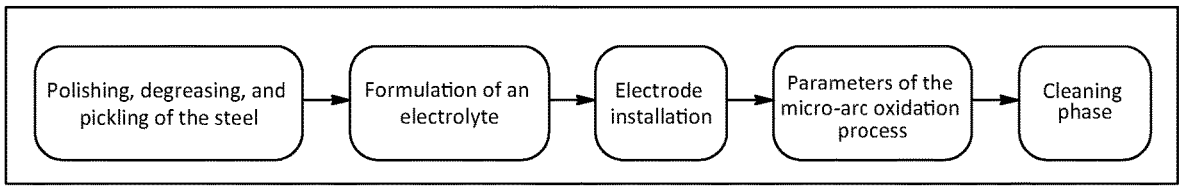
FIG. 2 is a flowchart of a preparation process of a boron-containing low-carbon steel oxide film according to one embodiment of the present invention.

A flowchart of a preparation process of the boron-containing low-carbon steel oxide film according to embodiments of the present invention is shown in FIG. 2.

The present invention further provides the boron-containing low-carbon steel oxide film obtained by using the preparation method. The oxide film includes an $Al_2O_3$ ceramic film covering the substrate surface of the boron-containing low-carbon steel, where the insulation resistance of the $Al_2O_3$ ceramic film is 100 MΩ to 150 MΩ. The $Al_2O_3$ ceramic film prepared in the present invention is equivalent to an insulator used to close an interfacial gap between a boron-containing low-carbon steel rivet and a contact metal (magnesium alloy). Thus, an electron flow circuit is suppressed, and galvanic corrosion is avoided.

The boron-containing low-carbon steel oxide film provided by the present invention is shown in FIG. 1. The insulating layer in FIG. 1 is the $Al_2O_3$ ceramic film. The insulator film lies at an interfacial gap between a boron-containing low-carbon steel rivet (Fe) and a contact metal (Mg alloy), to realize effective insulation.

In the present invention, the $Al_2O_3$ ceramic film preferably has a thickness of 50 μm to 100 μm, and more preferably has a thickness of 60 μm to 75 μm.

By using the preparation method of the present invention, the $Al_2O_3$ ceramic film is grown in situ on the surface of the boron-containing low-carbon steel. The film has a dense and uniform structure and creates a secure metallurgical bond with the substrate, thus significantly enhancing the hardness, wear resistance and corrosion resistance of the film. An experimental result shows that: the Moh's hardness of the $Al_2O_3$ ceramic film obtained by means of micro-arc oxidation reaches 8.5 to 9, the friction coefficient thereof is 0.2 to 0.3 through a friction and wear test, and an annual corrosion rate thereof is 0.03 mm/y to 0.07 mm/y through analysis from a neutral salt spray test.

To further describe the present invention, the boron-containing low-carbon steel oxide film and the preparation method thereof provided by the present invention are described in detail below with reference to specific embodiments. However, these embodiments should not be construed as limitations to the protection scope of the present invention.

Embodiment 1

(1) Preprocessing: Crude boron-containing low-carbon steel 10B21 is mechanically polished, and then the polished steel is degreased in a sodium hydroxide solution at the temperature of 70° C. Afterwards, the steel is pickled for 3 minutes in a mixed solution of hydrochloric acid and sulfuric acid (the volume ratio of the hydrochloric acid to the sulfuric acid is 3:1) at the temperature of 70° C. Finally, a product obtained after the pickling is put in running clean water to remove the residual acid solution from the surface, to obtain boron-containing low-carbon steel 10B21.

(2) Formulation of an electrolyte: Sodium meta aluminate of 5 g/L, sodium dihydrogen phosphate of 2 g/L, sodium carbonate of 2 g/L, and glycerol of 2 g/L are selected. According to the foregoing formula, the selected chemicals are stirred and dissolved in water, and the pH value of the electrolyte is maintained at 8 to 12.

(3) Electrode installation: The obtained boron-containing low-carbon steel 10B21 is held and put into the electrolyte. A hanging fixture with good conductivity is used to hold the boron-containing low-carbon steel 10B21 to be subjected to a micro-arc oxidation process. One end of the fixture is connected to the anode in an electrolytic tank for micro-arc oxidation, and the boron-containing low-carbon steel 10B21 is completely immersed in the formulated electrolyte.

(4) Parameters of the micro-arc oxidation process: The current density is maintained at 10 mA/cm$^2$, the positive voltage is 450V, the negative voltage is 50V, the current frequency is 200 Hz, the ratio of positive frequency to negative frequency is 0.5, the positive duty ratio is 15%, the negative duty ratio is 25%, the reaction duration is 20 min, and the reaction temperature is controlled at 60° C.

(5) Cleaning phase: A product obtained after the micro-arc oxidation process is subjected to cleaning with clean water and ultrasonic cleaning with anhydrous ethanol successively. Then, the cleaned product is taken out and dried by blowing air, to obtain the boron-containing low-carbon steel oxide film.

Embodiment 2

(1) Preprocessing: Crude boron-containing low-carbon steel 10B21 is mechanically polished, and then the polished steel is degreased in a sodium hydroxide solution at the temperature of 90° C. Afterwards, the steel is pickled for 20 minutes in a mixed solution of hydrochloric acid and sulfuric acid (the volume ratio of the hydrochloric acid to the sulfuric acid is 3:1) at the temperature of 30° C. Finally, a product obtained after the pickling is put in running clean water to remove the residual acid solution from the surface, to obtain boron-containing low-carbon steel 10B21.

(2) Formulation of an electrolyte: Sodium meta aluminate of 25 g/L, sodium dihydrogen phosphate of 10 g/L, sodium carbonate of 15 g/L, and glycerol of 8 g/L are selected. According to the foregoing formula, the selected chemicals are stirred and dissolved in water, and the pH value of the electrolyte is maintained at 8 to 12.

(3) Electrode installation: The obtained boron-containing low-carbon steel 10B21 is held and put into the electrolyte. A hanging fixture with good conductivity is used to hold the boron-containing low-carbon steel 10B21 to be subjected to a micro-arc oxidation process. One end of the fixture is connected to the anode in an electrolytic tank for micro-arc oxidation, and the boron-containing low-carbon steel 10B21 is completely immersed in the formulated electrolyte.

(4) Parameters of the micro-arc oxidation process: The current density is maintained at 300 mA/cm$^2$, the positive voltage is 700V, the negative voltage is 100V, the current frequency is 2000 Hz, the ratio of positive frequency to negative frequency is 2, the positive duty ratio is 40%, the negative duty ratio is 10%, the reaction duration is 50 min, and the reaction temperature is controlled at 20° C.

(5) Cleaning phase: A product obtained after the micro-arc oxidation process is subjected to cleaning with clean water and ultrasonic cleaning with anhydrous ethanol successively. Then, the cleaned product is taken out and dried by blowing air, to obtain the boron-containing low-carbon steel oxide film.

Embodiment 3

(1) Preprocessing: Crude boron-containing low-carbon steel 10B21 is mechanically polished, and then the polished steel is degreased in a sodium hydroxide solution at the temperature of 80° C. Afterwards, the steel is pickled for 10 minutes in a mixed solution of hydrochloric acid and sulfuric acid (the volume ratio of the hydrochloric acid to the sulfuric acid is 3:1) at the temperature of 50° C. Finally, a product obtained after the pickling is put in running clean water to remove the residual acid solution from the surface, to obtain boron-containing low-carbon steel 10B21.

(2) Formulation of an electrolyte: Sodium meta aluminate of 15 g/L, sodium dihydrogen phosphate of 5 g/L, sodium carbonate of 10 g/L, and glycerol of 5 g/L are selected. According to the foregoing formula, the selected chemicals are stirred and dissolved in water, and the pH value of the electrolyte is maintained at 8 to 12.

(3) Electrode installation: The obtained boron-containing low-carbon steel 10B21 is held and put into the electrolyte. A hanging fixture with good conductivity is used to hold the boron-containing low-carbon steel 10B21 to be subjected to a micro-arc oxidation process. One end of the fixture is connected to the anode in an electrolytic tank for micro-arc oxidation, and the boron-containing low-carbon steel 10B21 is completely immersed in the formulated electrolyte.

(4) Parameters of the micro-arc oxidation process: The current density is maintained at 100 mA/cm$^2$, the positive voltage is 600V, the negative voltage is 80V, the current frequency is 1000 Hz, the ratio of positive frequency to negative frequency is 1, the positive duty ratio is 25%, the negative duty ratio is 15%, the reaction duration is 35 min, and the reaction temperature is controlled at 40° C.

(5) Cleaning phase: A product obtained after the micro-arc oxidation process is subjected to cleaning with clean water and ultrasonic cleaning with anhydrous ethanol successively. Then, the cleaned product is taken out and dried by blowing air, to obtain the boron-containing low-carbon steel oxide film.

Embodiment 4

(1) Preprocessing: Crude boron-containing low-carbon steel 10B21 is mechanically polished, and then the polished steel is degreased in a potassium hydroxide solution at the temperature of 80° C. Afterwards, the steel is pickled for 10 minutes in hydrochloric acid at the temperature of 50° C. Finally, a product obtained after the pickling is put in running clean water to remove the residual acid solution from the surface, to obtain boron-containing low-carbon steel 10B21.

(2) Formulation of an electrolyte: Sodium meta aluminate of 15 g/L, sodium dihydrogen phosphate of 5 g/L, sodium carbonate of 10 g/L, and glycerol of 5 g/L are selected. According to the foregoing formula, the selected chemicals are stirred and dissolved in water, and the pH value of the electrolyte is maintained at 8 to 12.

(3) Electrode installation: The obtained boron-containing low-carbon steel 10B21 is held and put into the electrolyte. A hanging fixture with good conductivity is used to hold the boron-containing low-carbon steel 10B21 to be subjected to a micro-arc oxidation process. One end of the fixture is connected to the anode in an electrolytic tank for micro-arc oxidation, and the boron-containing low-carbon steel 10B21 is completely immersed in the formulated electrolyte.

(4) Parameters of the micro-arc oxidation process: The current density is maintained at 100 mA/cm$^2$, the positive voltage is 600V, the negative voltage is 80V, the current frequency is 1000 Hz, the ratio of positive frequency to negative frequency is 1, the positive duty ratio is 25%, the negative duty ratio is 15%, the reaction duration is 35 min, and the reaction temperature is controlled at 40° C.

(5) Cleaning phase: A product obtained after the micro-arc oxidation process is subjected to cleaning with clean water and ultrasonic cleaning with anhydrous ethanol successively. Then, the cleaned product is taken out and dried by blowing air, to obtain the boron-containing low-carbon steel oxide film.

Embodiment 5

(1) Preprocessing: Crude boron-containing low-carbon steel 10B21 is mechanically polished, and then the polished steel is degreased in a sodium hydroxide solution at the temperature of 80° C. Afterwards, the steel is pickled for 10 minutes in a mixed solution of hydrochloric acid and sulfuric acid (the volume ratio of the hydrochloric acid to the sulfuric acid is 3:1) at the temperature of 50° C. Finally, a product obtained after the pickling is put in running clean water to remove the residual acid solution from the surface, to obtain boron-containing low-carbon steel 10B21.

(2) Formulation of an electrolyte: Sodium meta aluminate of 15 g/L, sodium dihydrogen phosphate of 5 g/L, sodium carbonate of 10 g/L, glycerol of 5 g/L, and odium tetraborate of 1 g/L are selected. According to the foregoing formula, the selected chemicals are stirred and dissolved in water, and the pH value of the electrolyte is maintained at 8 to 12.

(3) Electrode installation: The obtained boron-containing low-carbon steel 10B21 is held and put into the electrolyte. A hanging fixture with good conductivity is used to hold the boron-containing low-carbon steel 10B21 to be subjected to a micro-arc oxidation process. One end of the fixture is connected to the anode in an electrolytic tank for micro-arc oxidation, and the boron-containing low-carbon steel 10B21 is completely immersed in the formulated electrolyte.

(4) Parameters of the micro-arc oxidation process: The current density is maintained at 100 mA/cm$^2$, the positive voltage is 600V, the negative voltage is 80V, the current frequency is 1000 Hz, the ratio of positive frequency to negative frequency is 1, the positive duty ratio is 25%, the negative duty ratio is 15%, the reaction duration is 35 min, and the reaction temperature is controlled at 40° C.

(5) Cleaning phase: A product obtained after the micro-arc oxidation process is subjected to cleaning with clean water and ultrasonic cleaning with anhydrous ethanol successively. Then, the cleaned product is taken out and dried by blowing air, to obtain the boron-containing low-carbon steel oxide film.

Embodiment 6

(1) Preprocessing

Crude boron-containing low-carbon steel 10B21 is mechanically polished, and then the polished steel is degreased in a sodium hydroxide solution at the temperature of 80° C. Afterwards, the steel is pickled for 10 minutes in a mixed solution of hydrochloric acid and sulfuric acid (the volume ratio of the hydrochloric acid to the sulfuric acid is 3:1) at the temperature of 50° C. Finally, a product obtained after the pickling is put in running clean water to remove the residual acid solution from the surface, to obtain boron-containing low-carbon steel 10B21.

(2) Formulation of an electrolyte: Sodium meta aluminate of 15 g/L, sodium dihydrogen phosphate of 5 g/L, sodium carbonate of 10 g/L, glycerol of 5 g/L, and odium tetraborate of 10 g/L are selected. According to the foregoing formula, the selected chemicals are stirred and dissolved in water, and the pH value of the electrolyte is maintained at 8 to 12.

(3) Electrode installation: The obtained boron-containing low-carbon steel 10B21 is held and put into the electrolyte. A hanging fixture with good conductivity is used to hold the boron-containing low-carbon steel 10B21 to be subjected to a micro-arc oxidation process. One end of the fixture is connected to the anode in an electrolytic tank for micro-arc oxidation, and the boron-containing low-carbon steel 10B21 is completely immersed in the formulated electrolyte.

(4) Parameters of the micro-arc oxidation process: The current density is maintained at 100 mA/cm$^2$, the positive voltage is 600V, the negative voltage is 80V, the current frequency is 1000 Hz, the ratio of positive frequency to negative frequency is 1, the positive duty ratio is 25%, the negative duty ratio is 15%, the reaction duration is 35 min, and the reaction temperature is controlled at 40° C.

(5) Cleaning phase: A product obtained after the micro-arc oxidation process is subjected to cleaning with clean water and ultrasonic cleaning with anhydrous ethanol successively. Then, the cleaned product is taken out and dried by blowing air, to obtain the boron-containing low-carbon steel oxide film.

Comparative Example 1

The boron-containing low-carbon steel 10B21 obtained after preprocessing in step (1) in Embodiment 3 is used as the comparative example 1.

Comparative Example 2

A zinc coating prepared on the boron-containing low-carbon steel by using the method in Embodiment 3 is used as the comparative example 2.

Performance of films obtained in Embodiments 1 to 6 and the comparative examples 1 and 2 is tested, to obtain results shown in Table 1.

The Moh's hardness is measured by means of scratching. Specifically, a pyramidal diamond needle is used to make a scratch on the surface of a test sample, and a measured depth of the scratch indicates the hardness.

The friction coefficient is measured through a friction and wear test by using a friction and wear experiment GBT 12444.1-1990.

An annual corrosion rate is obtained through analysis from a neutral salt spray test which adopts the international standard ISO 3768-1976: Neutral Salt Spray Test for Metal Coating (NSS test).

TABLE 1

Test results about thickness and performance of films obtained in Embodiments 1 to 6 and comparative examples 1 and 2

| | Film thickness (μm) | Moh's hardness | Friction coefficient | Annual corrosion rate (mm/y) |
|---|---|---|---|---|
| Embodiment 1 | 50 | 8.5 | 0.26 | 0.070 |
| Embodiment 2 | 64 | 8.8 | 0.30 | 0.045 |
| Embodiment 3 | 75 | 8.6 | 0.28 | 0.063 |
| Embodiment 4 | 70 | 8.7 | 0.25 | 0.058 |
| Embodiment 5 | 80 | 8.9 | 0.22 | 0.035 |
| Embodiment 6 | 100 | 9.0 | 0.20 | 0.030 |
| Comparative Example 1 | 0 | 4.8 | 0.63 to 0.7 | 0.5 to 0.8 |
| Comparative Example 2 | 100 | 2.5 | 0.7 to 0.8 | 0.3 to 0.5 |

It can be seen from the foregoing Embodiments 1 to 6 and the comparative examples 1 and 2 that, in comparison with the boron-containing low-carbon steel substrate and the zinc coating, the boron-containing low-carbon steel oxide film provided by the present invention is significantly enhanced in hardness, wear resistance and corrosion resistance.

It can be known by comparison between Embodiments 3 and 6 that, when the sodium tetraborate is added to the electrolyte, the obtained boron-containing low-carbon steel oxide film is slightly enhanced in hardness and reduced in friction coefficient and annual corrosion rate. Thus, the addition of the sodium tetraborate to the electrolyte can flatten the film and enhance the density of the film, thus enhancing the hardness, wear resistance and corrosion resistance of the film.

Figure 3:
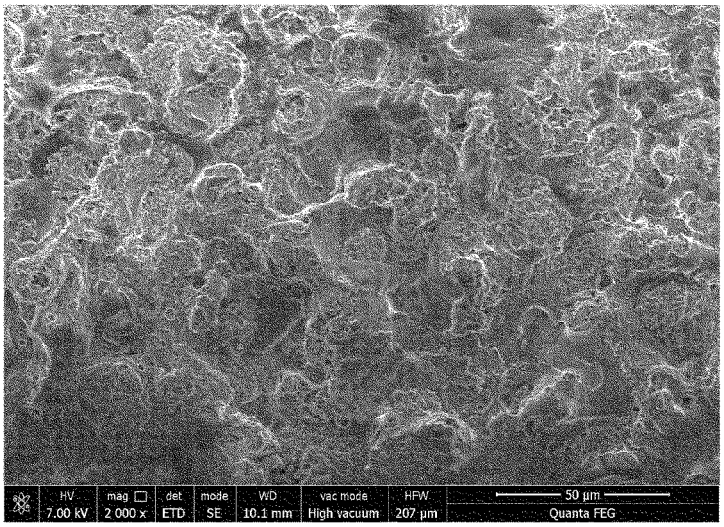
FIG. 3 is a Scanning Electron Microscope (SEM)-generated diagram of a surface of a boron-containing low-carbon steel oxide film prepared in Embodiment 6 of the present invention.
Figure 4:
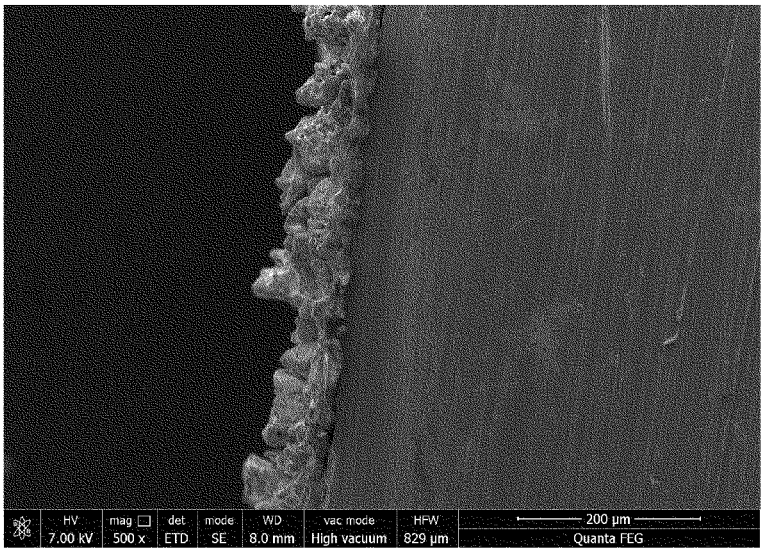
FIG. 4 is a SEM-generated diagram of the boron-containing low-carbon steel oxide film prepared in Embodiment 6 of the present invention.

FIG. 3 and FIG. 4 respectively show a surface and an SEM interface diagram of the boron-containing low-carbon steel oxide film prepared in Embodiment 6 of the present invention. It can be seen from FIG. 3 and FIG. 4 that a porous aluminum oxide film is grown on the steel surface. The film has a dense and porous surface and creates a secure bond with the substrate. The thickness of the film reaches around 100 μm.

Several examples are used for illustration of the principles and implementation methods of the present invention. The description of the embodiments is used to help illustrate the method and its core principles of the present invention. In addition, those skilled in the art can make various modifications in terms of specific embodiments and scope of application in accordance with the teachings of the present invention. In conclusion, the content of this specification shall not be construed as a limitation to the invention.

The embodiments described above are only descriptions of preferred embodiments of the present invention, and do not intended to limit the scope of the present invention. Various variations and modifications can be made to the technical solution of the present invention by those of ordinary skills in the art, without departing from the design and spirit of the present invention. The variations and modifications should all fall within the claimed scope defined by the claims of the present invention.

What is claimed is:

1. A method for preparing a boron-containing low-carbon steel oxide film, comprising:

performing micro-arc oxidation on boron-containing low-carbon steel in an electrolyte by using the boron-containing low-carbon steel as an anode, to obtain a boron-containing low-carbon steel oxide film, wherein the electrolyte contains sodium meta aluminate of 5 g/L to 25 g/L, sodium dihydrogen phosphate of 2 g/L to 10 g/L, sodium carbonate of 2 g/L to 15 g/L, and glycerol of 2 g/L to 8 g/L, wherein parameters of the micro-arc oxidation comprise: current density of 0.1 mA/cm$^2$ to 300 mA/cm$^2$, a positive voltage of 500V to 700V, a negative voltage of 20V to 80V, a current frequency of 200 Hz to 2000 Hz, a ratio of positive frequency to negative frequency of 1 to 2, a positive duty ratio of 15% to 40%, a negative duty ratio of 10% to 20%, reaction duration of 20 min to 60 min, and a reaction temperature of 20° C. to 60° C.

2. The method of claim 1, wherein the electrolyte further contains sodium tetraborate of 1 g/L to 10 g/L.

3. The method of claim 2, wherein a pH value of the electrolyte is 8 to 12.

4. The method of claim 1, wherein a pH value of the electrolyte is 8 to 12.

5. A method for preparing a boron-containing low-carbon steel oxide film, comprising:

performing micro-arc oxidation on boron-containing low-carbon steel in an electrolyte by using the boron-containing low-carbon steel as an anode, to obtain a boron-containing low-carbon steel oxide film, wherein the electrolyte contains sodium meta aluminate of 5 g/L to 25 g/L, sodium dihydrogen phosphate of 2 g/L to 10 g/L, sodium carbonate of 2 g/L to 15 g/L, and glycerol of 2 g/L to 8 g/L, and wherein parameters of the micro-arc oxidation comprise: current density of 0.5 mA/cm$^2$ to 300 mA/cm$^2$, a positive voltage of 450V to 700V, a negative voltage of 50V to 100V, a current frequency of 200 Hz to 2000 Hz, a ratio of positive frequency to negative frequency of 0.5 to 2, a positive duty ratio of 15% to 40%, a negative duty ratio of 10% to 25%, reaction duration of 20 min to 50 min, and a reaction temperature of 20° C. to 60° C.

6. The method of claim 1, wherein the boron-containing low-carbon steel is polished, degreased, and pickled successively before the micro-arc oxidation.

7. The method of claim 6, wherein the degreasing is performed in an alkaline solution at a temperature of 70° C. to 90° C.

8. The method of claim 6, wherein the pickling is performed in an acid solution at a temperature of 30° C. to 70° C.

* * * * *